US005105914A

United States Patent [19]

Holden

[11] Patent Number: 5,105,914

[45] Date of Patent: Apr. 21, 1992

[54] STAIRLIFT

[76] Inventor: Raymond J. Holden, 1 Sutton Hall Cottages, Elton Head Road, St. Helens, England, WA9 5BN

[21] Appl. No.: 677,237

[22] Filed: Mar. 29, 1991

[30] Foreign Application Priority Data

Mar. 31, 1990 [GB] United Kingdom ..... 9007291

[51] Int. Cl.[5] ..... B66B 9/06

[52] U.S. Cl. ..... 187/12; 187/27; 187/20

[58] Field of Search ..... 187/12, 13, 10, 27, 187/20

[56] References Cited

U.S. PATENT DOCUMENTS 2,674,347 4/1954 Thompson ..... 187/12
3,662,859 5/1972 Flinchbaugh ..... 187/12
3,833,092 9/1974 Flinchbaugh ..... 187/12
4,438,830 3/1984 Born ..... 187/12
4,564,086 1/1986 Kingston ..... 187/12

*Primary Examiner*—D. Glenn Dayoan
*Attorney, Agent, or Firm*—Spencer, Frank & Schneider

[57] ABSTRACT

In a stairlift comprising a guide track, fixed to the steps of the stairs, the guide track does not protrude below the first or second riser at the foot of the stairs and/or beyond the top of the stairs into the landing area. A second track is mounted on and supported by the first track. The length of the second track is less than the length of the flight of stairs and is selectably moveable between a position whereat the second track protrudes into the landing area at the top of the stairs, and a position whereat the second track protrudes below the first or second riser at the foot of the stairs. The user of the lift is supported on a carriage, mounted on the second track.

10 Claims, 4 Drawing Sheets

STAIRLIFT

BACKGROUND OF THE INVENTION

The present invention relates to a stairlift.

Stairlifts have been used for many years in order to carry a person, who has difficulty climbing the stairs of their own accord, up or down the stairs. Such lifts consist of a carriage, upon which the person can sit or stand and a guide track along which the carriage can move.

One of the drawbacks of the known stairlifts is that, in many cases the guide track is of necessity longer than the flight of stairs, such that the track protrudes above the stairs into the landing area and/or beyond the first or second riser at the bottom of the stairs such that the guide track can cause an obstruction. For instance, if there is a doorway in the vicinity of the top or bottom of the stairs, the guide track may prevent or hinder the opening and closing of that door.

In the past this has been overcome by making the ends of the track foldable, such that the portion of the track causing an obstruction can be folded up and back upon itself, away from the top or bottom of the stairs where it was causing an obstruction. The track thus folded cannot be used safely and it is in fact a safety requirement in many countries that the lift must be inoperable when the guide track has been lifted in this way. This has the obvious consequence that if a user of the lift is, say, upstairs, and somebody has folded back the track at the bottom of the stairs in order to leave the house, the user of the lift, if he is alone in the house, cannot unfold the track. Therefore, the lift cannot be used and the user is unable to come down the stairs until someone returns to the house and unfolds the track.

The foregoing drawback has also been overcome by making the track shorter than the stairs with the consequence that the travel of the carriage, on which the user sits or stands, starts and finishes within the length of the flight of stairs. Therefore, the user must hoist himself partially up or down the stairs in order to get on or off the carriage which can be both difficult and dangerous.

It is an object of the present invention to provide a stairlift which overcomes or alleviates the problems associated with the known stairlifts.

SUMMARY OF THE INVENTION

In accordance with the present invention, a stairlift comprises a carriage movably mounted on a guide track which is adapted to be fitted in a position on or over a flight of stairs, in which the guide track, when fitted on the stairs, does not protrude into the landing area at the top of the flight of stairs and/or below the first or second riser at the foot of the flight of stairs and in which, between the carriage and the guide track, is a movable track which is supported on the guide track and is controllably moveable along the guide track between a position whereat it protrudes into the landing area and a position whereat it protrudes below the first or second riser at the foot of the flight of stairs.

Therefore, with such a stairlift it is not necessary for the guide track to protrude, for instance, into the hallway at the foot of the stairs as in the hitherto known systems because the moveable track which carries the carriage can be moved in or out of this area at will, thereby leaving the hallway free of fixed structures.

In a preferred embodiment, the carriage is mounted on and is controllably moveable along the moveable track.

With the carriage able to move along the length of the moveable track, the carriage can be moved to a convenient position for the user to get on or off the lift.

The moveable track and the carriage can be moved either by a common driving mechanism or by mutually independent driving mechanisms.

In some embodiments, the moveable track is moved to the top or bottom of the flight of stairs before the carriage is moved.

In another embodiment, the carriage is moved along the moveable track as the moveable track is moved along the guide track.

Preferably, the length of the moveable track is the same as or greater than the length of the carriage, but is less than the length of the flight of stairs.

Conveniently, the movement of the moveable track and/or the carriage is controlled from a point at the bottom of the flight of stairs and/or on the carriage and/or at the top of the flight of stairs.

Preferably, the moveable track has safety edges such that, if the moveable track meets an obstruction, movement towards the obstruction is prevented and only movement away from the obstruction is permitted.

The guide track can comprise a substantially straight single track length or a plurality of interconnectable track lengths which, when connected together, form a substantially straight single track.

BRIEF DESCRIPTION OF THE DRAWINGS

By way of example only, specific embodiments of the present invention will now be described with reference to the accompanying drawings, in which:—

DESCRIPTION OF THE PREFERRED EMBODIMENTS

Figure 1:
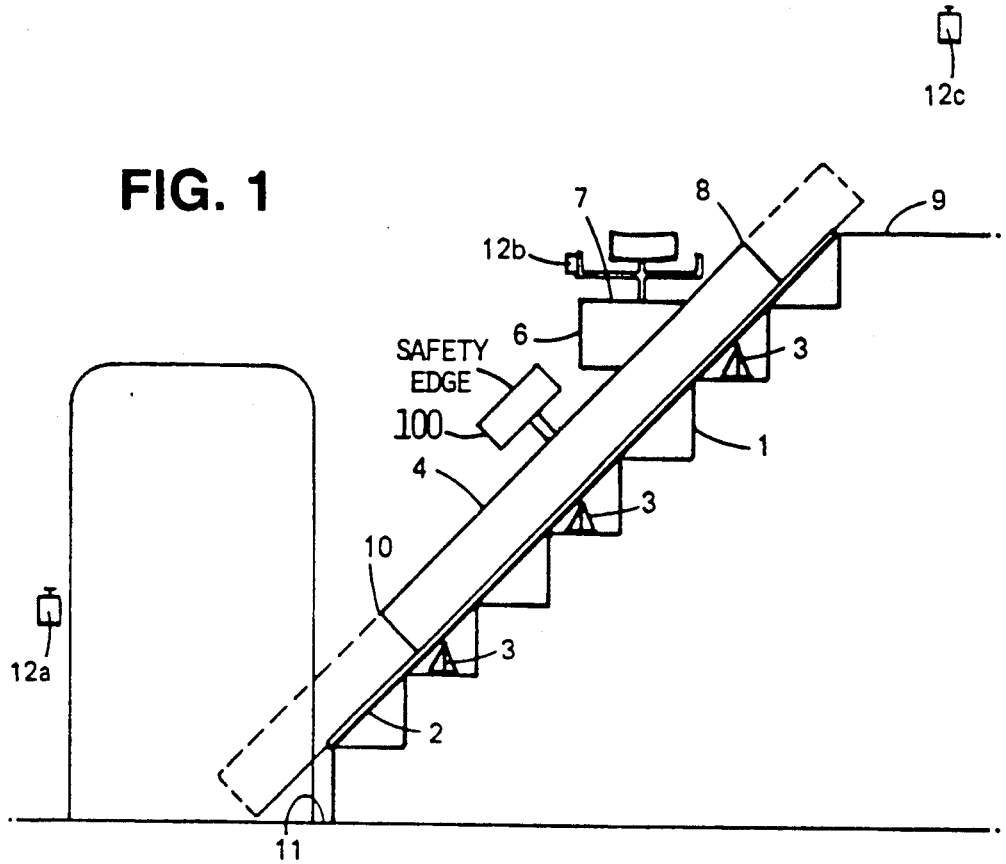
FIG. 1 is a highly schematic view of the operation of the stairlift constructed in accordance with one embodiment of the present invention.
Figure 2:
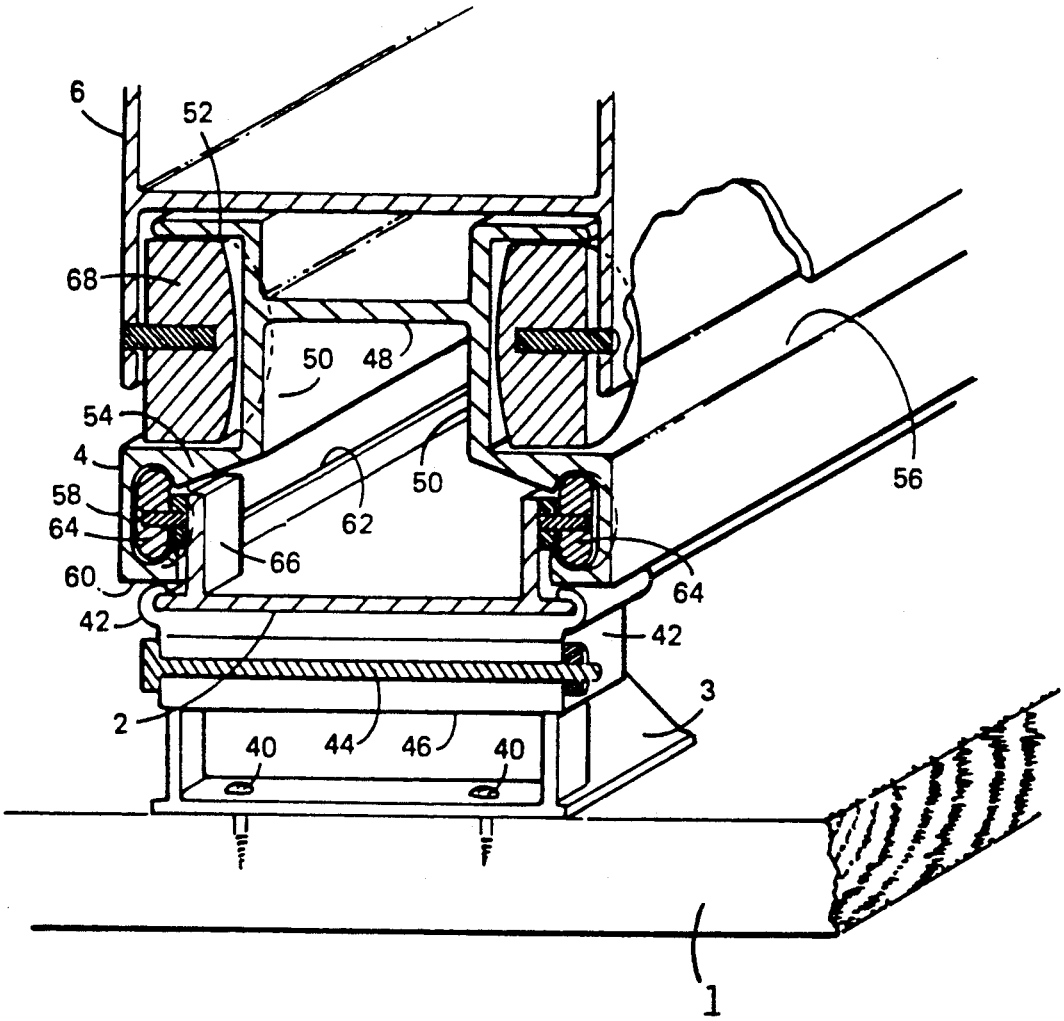
FIG. 2 is a sectional perspective view of the stairlift to a larger scale.

Referring to FIGS. 1 and 2, a stairlift comprises a guide or first track 2 which is fixed with respect to the flight 1 of stairs, a moveable or second track 4 supported on the guide track 2 and a carriage 6 mounted on the moveable track 4.

The guide track 2 is fixed by such means as brackets 3 to the treads of the stairs or over the proximity of the stairs such that it lies along or over the flight of stairs. The brackets 3 are secured to the stairs by screws 40 and to the track 2 by clamps 42. A long bolt 44 passes through the clamps 42 and through a tube 46 forming part of the bracket 3. Tightening the bolt 44 tightens the clamps 42 against the track 2 and against the bracket 3.

The guide track 2 comprises a substantially straight single track length or a plurality of interconnectible track lengths which, when connected together form a substantially straight single track. The guide track 2 when in situ does not protrude both above the stairs into the landing area and below the first or second riser at the foot of the flight of stairs. In the illustrated embodiments, the guide track 2 is shown as extending from the top step of the flight of stairs to the bottom step of the flight, but the positioning of the guide track is not restricted to this and the guide track could conceivably be shorter than this for reasons that will become clearer hereinafter.

The moveable track 4 comprises a bar section, for example, of extruded aluminium, of approximately H-shape. It has a web 48 joining together integral channels 50, each of which has upper and lower flanges 52, 54 to define a respective outwardly facing upper guideway 56. The lower flanges 54 have downward extensions 58 and inturned lips 60 to define respective inwardly facing lower guideways 62. The guide track 2 supports two rows of longitudinally spaced rollers 64 which are closely received in the lower guideways 62. The upper or second track 4 is thereby supported on the lower or guide track 2 for longitudinal movement therealong without any undue lateral or vertical play. The rollers 64 can comprise simpler rollers or stub shafts fixed to lugs 66 on the guide track 2 or can comprise roller bearings whose outer races form the rollers.

The moveable track 4 whilst supported on the guide track 2 is selectably and controllably movable along and beyond the length of the guide track 2, from a position where an upper end 8 of the moveable track would protrude beyond the top step into the landing area 9 of the flight of stairs to a position where a lower end 10 of the moveable track would protrude beyond the first or second riser at the foot 11 of the stairs. An example of the extent of the movement of the moveable track 4 is illustrated by the dot-dash lines in the Figures.

The carriage 6 has four rollers 68 at its four lower corners. These rollers 68 are closely received in the upper guideways 56 whereby the carriage 6 is guided for longitudinal movement along the movable track 4, again without any undue lateral or vertical play.

The carriage 6 mounted on the moveable track 4 is used to support a user of the lift, and the user, together with the carriage, are carried up or down the stairs by the movement of the moveable track 4 along the guide track 2. The carriage 6 may be in the form of a suitably adapted seat 7 onto which the user can hoist himself or may be adapted to receive and lock a wheelchair thereon or may simply be adapted so that the user can stand on it.

Control units **12*a*, 12*b*, 12*c* are provided at the bottom of the flight of stairs, on the carriage 6 and at the top of the flight of stairs, respectively. Each of the control units can control the movement of the moveable track 4 along the guide track 2**.

In order to use the lift, for example, when the user is at the bottom of the flight of stairs, and if the carriage is not at the bottom of the stairs, the user can summon the carriage by operating the control unit **12*a*. The moveable track 4 moves down the guide track 2 carrying the carriage with it until it reaches its end position. The user then gets on the carriage 6 and can move the carriage 6 and the movable track 4 up the guide track 2 to the top flight of the stairs where the user can get off the lift. Similarly if the user is at the top of the flight of stairs and the carriage 6 is at the bottom, the user can summon the carriage by operating the control unit 12*c***.

The moveable track 4 is shorter than the flight of stairs and as already described, is capable of protruding beyond either end of the guide track 2 when it is moved. Therefore, the guide track 2 does not have to protrude beyond the step area of the flight of stairs because the moveable track 4 can be moved to a required position at the foot or top of the flight of stairs. Therefore the track, in the form of the moveable track can be moved easily out of the way when, for instance, somebody wants to open a door, but can be returned easily at will by a user.

The operative length of the guide track is increased by the length by which the moveable track is capable of protruding beyond either end of the guide track. Therefore, the same guide/moveable track unit could fit several sizes of flights of stairs, with the potential length of the track being limited to fit a particular flight of stairs by the provision of adjustable stop plates or switches (not illustrated).

The moveable track 4 is fitted with safety edges, one of which is illustrated at 100 in FIG. 1 such that, if the moveable track 4 meets an obstruction in its path, movement of the track is prevented in the direction of the obstruction and only movement away from the obstruction is permitted. Sensitive edges, which are similar to the edges of this invention are described in British Standard 5776 of 1979.

Specifically, according to British Standard 5776, a sensitive edge is a safety device attached to any edge of the carriage to obviate a hazard. Operation of a sensitive edge causes the supply to a motor driving the lift to be interrupted and prevent it from producing any movement of the carriage toward an obstruction. Safety edge 100 has the same function and operates in the same way as the sensitive edge described in British Standard 5776, except that it is attached to the moveable track 4 rather than directly to the carriage 6.

Figure 3:
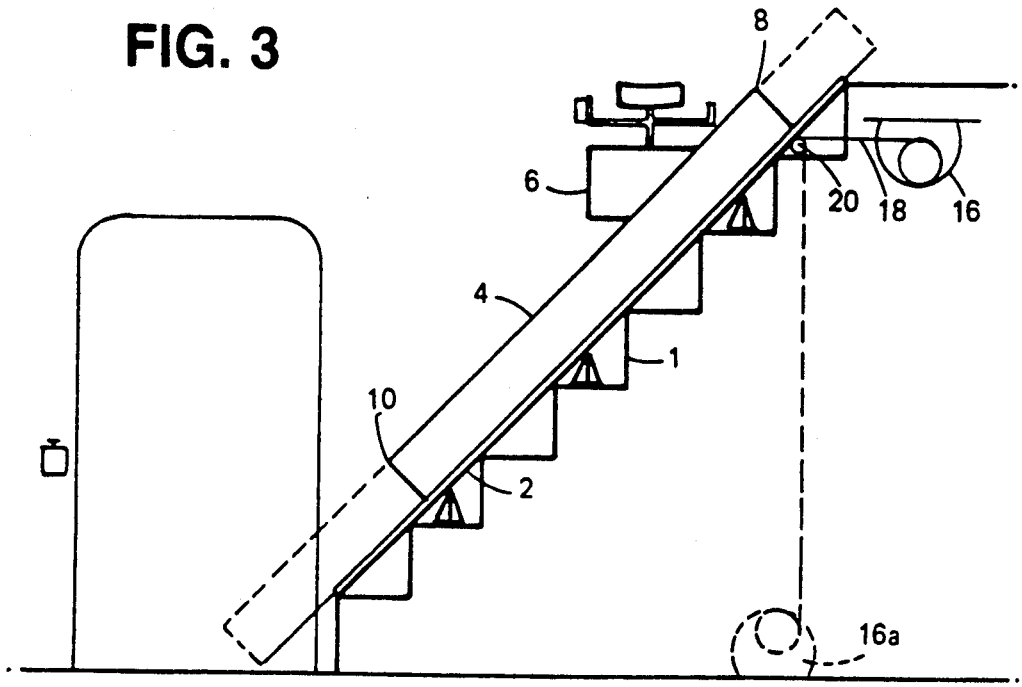
FIG. 3 is a schematic view of the stairlift of FIGS. 1 and 2, illustrating one way of moving the moveable track along the guide track.

The movement of the moveable track 4 and/or the carriage 6 can be achieved in several ways, examples of which are illustrated in the accompanying drawings, and are as follows:

FIG. 3 illustrates a winching mechanism used to hoist the moveable track 4 up the guide track 2. A rope, tape or chain 18 of a winch 16 is threaded around a pulley 20 which is secured to a fixed object, such as the guide track 2 or the stairwell, and is then securely attached to the moveable track 4. The moveable track 4 is hoisted up the stairs by the winch 16 winding in the chain 18 and is lowered down the flight 1 of stairs by the winch 16 unreeling the chain 18 with the moveable track 4 moving back down the guide track 2 in a controlled manner by means of a combination of its own weight and the speed of release of the chain 18 from the winch 16. The winch 16 is secured to a fixed object. An alternative position of winch **16*a* is shown in FIG. 3 in dotted lines. In this instance the carriage 6** would be moved by a separate power source.

Figure 4:
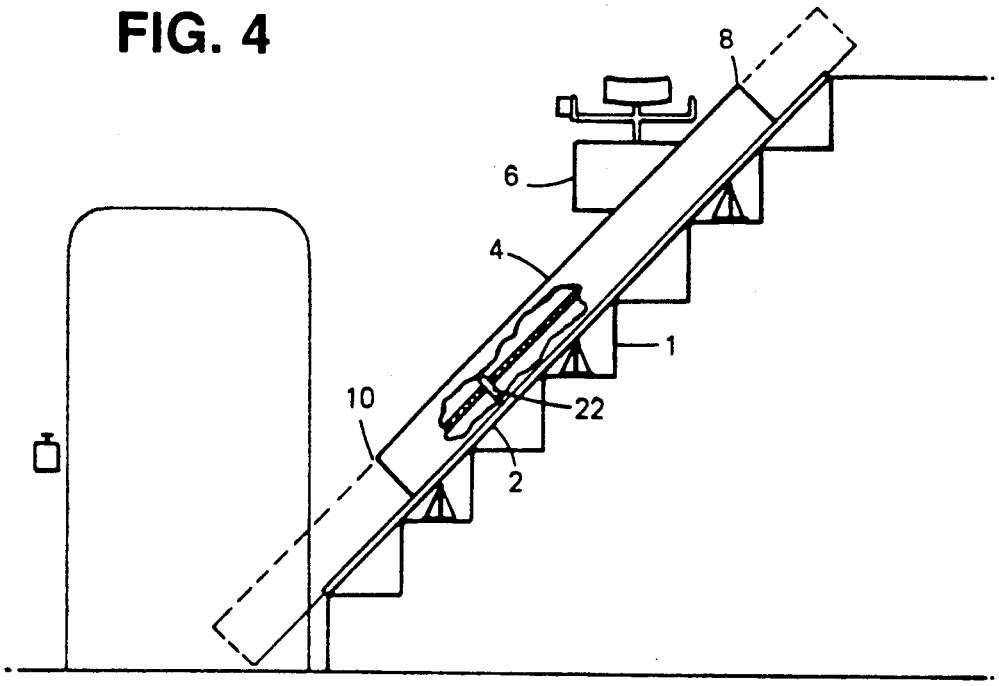
FIG. 4 is a schematic view of a modification of the stairlift of FIG. 1, illustrating a further way of moving the moveable track along the guide track.

FIG. 4 illustrates an alternative means for moving the moveable track 4 on the guide track 2. In this instance a screw and nut arrangement or a reciprocating (recirculating) ball actuator 22 is used to power the moveable track 4 along the guide track 2. In this instance the carriage 6 would be moved, if desired, by a separate power source (not shown).

Figure 5:
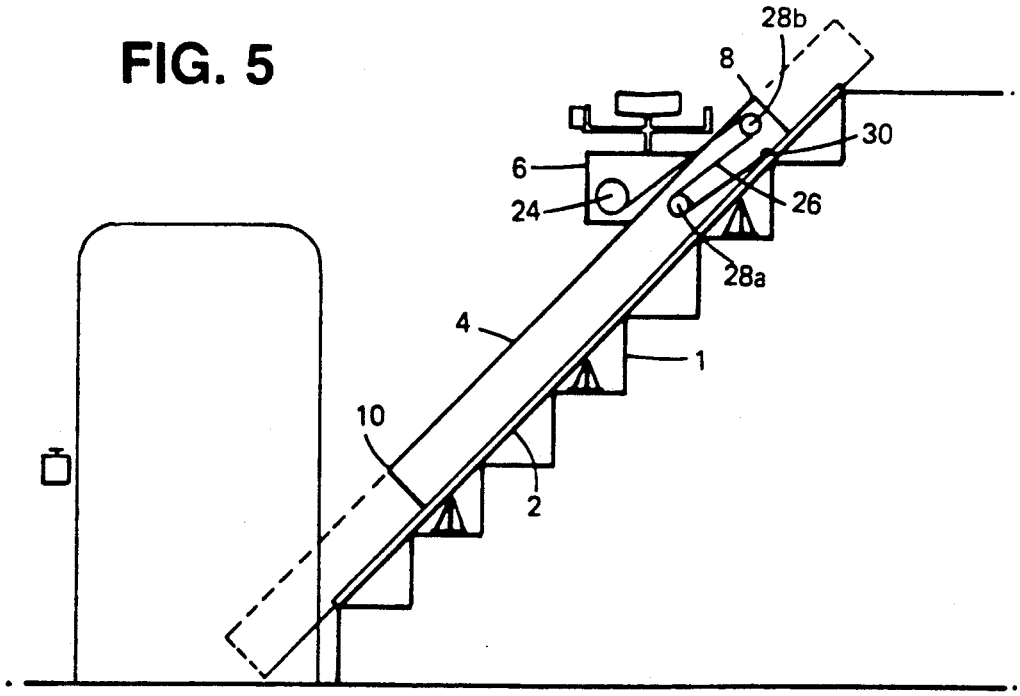
FIG. 5 is a schematic view of the stairlift of FIG. 1 illustrating one way of moving both the carriage and the moveable track.

FIG. 5 illustrates the situation where the same prime mover or motor 24 is used to move the moveable track 4 and the carriage 6. The motor 24 is mounted in the carriage 6 and draws in a rope or chain 26 which is trained around a system of pulleys 28*a*, 28*b* which are located in the moveable track 4. The rope or chain 26 is anchored to a fixed point 30 at the top of the flight 1 of stairs or of the guide track 2. By winding in the rope or chain 26 in this fashion, the moveable track 4 is drawn up the guide track 2. Once the full extent of rope 26 is drawn up from within the moveable track 4, the carriage 6 is then drawn up the moveable track 4. The carriage 6 and moveable track 4 are moved back down the stairs by releasing the chain or rope 26.

Figure 6:
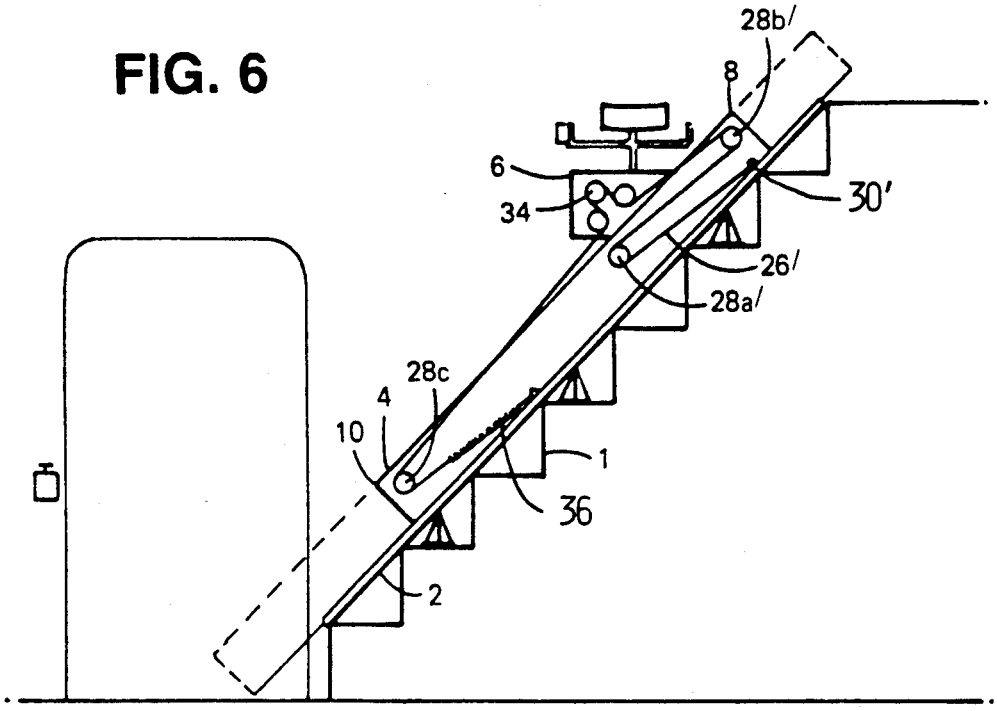
FIG. 6 is a schematic view of the stairlift of FIG. 1 illustrating a further way of moving the carriage and the moveable track.

FIG. 6 illustrates a further possibility of using the same prime mover to control the movement of the moveable track 4 and the carriage 6. In this instance, a driven sprocket wheel system 34 is disposed in the carriage 6 and a chain 26' is fixed to the anchorage point 30' from where it is entrained around a system of pulleys 28*a*' and 28*b*' journalled on the movable track 4. The chain is then fed round the sprocket system 34 in the carriage 6 and then looped over a further pulley 28*c*, journalled on a moveable track 4. Beyond the pulley 28*c*, the chain is tensioned for example, by a spring 36 secured to the moveable track 4 or by a weight. The moveable track 4 and carriage 6 are driven up and/or down the flight 1 of stairs and/or with respect to each other by the driven sprocket wheel system 34 driving the chain between its fixed anchorage 30' and its fixture by the spring 36.

Figure 7:
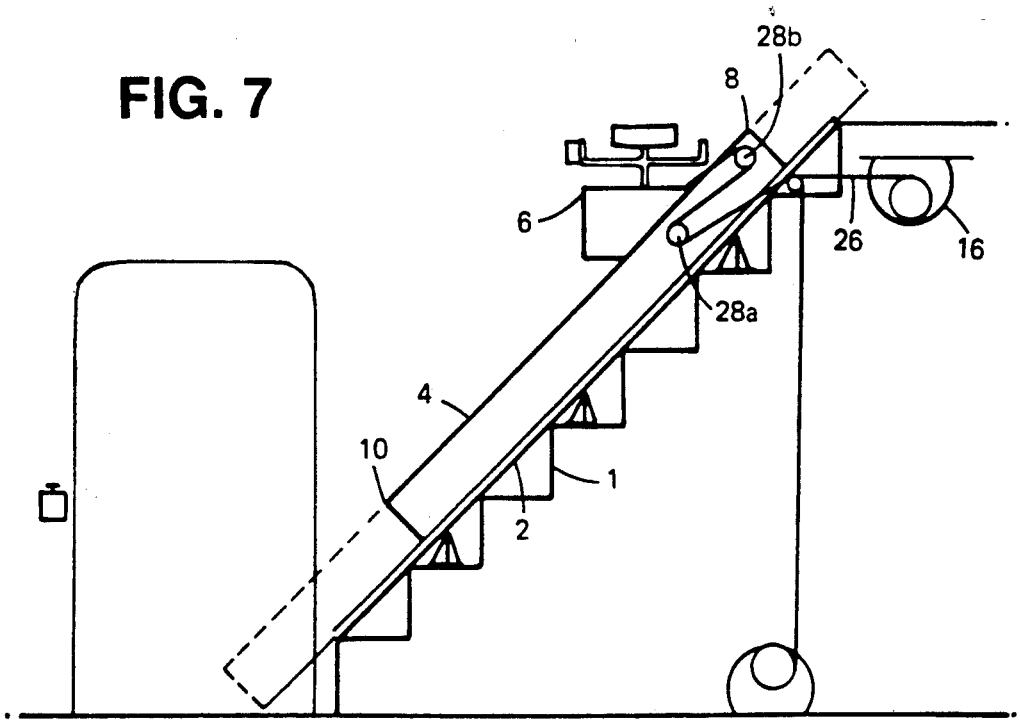
FIG. 7 is a schematic view of the stairlift of FIGS. 1 and 2, illustrating yet another way of moving the carriage and the moveable track.

FIG. 7 illustrates a further possibility of moving the moveable track 4 and the carriage 6 in which, like the system illustrated in FIG. 3 the driving means 16 is remote from the lift and is used to move the moveable track 4 up and down the flight 1 of stairs, but unlike the system shown in FIG. 3, it also moves the carriage 6 by the system of pulleys 28*a*,28*b* and rope or chain 26, which in this case is fixed to the carriage 6.

A fail-safe device (not illustrated) is fitted to the lift, such that, if a suspension failure occurs, movement of the track and the carriage is restricted to within 20 mm.

I claim:

1. A stairlift for a flight of stairs comprising: first track means; means for fixing said first track means over said flight of stairs such that said first track means does not protrude both into a landing area at the top of the flight of stairs and below a first riser at the foot of the flight of stairs; second track means moveably mounted on and supported by the first track means; means for controllably moving the second track means along the first track means between a position whereat the second track protrudes beyond the first track means into said landing area and a position whereat the second track means protrudes beyond the first track means below the first riser at the foot of the flight of stairs; and a carriage mounted on the said second track means.

2. A stairlift according to claim 1, which further comprises means for controllably moving the carriage along the second track means.

3. A stairlift according to claim 1, further comprising means for driving the second track means along the first track means, said means for driving being operable by said means for moving the second track means.

4. A stairlift according to claim 2, further comprising means for driving the carriage along the second track means, said means for driving the carriage being operable by said means for moving the carriage.

5. A stairlift according to claim 1, wherein said means for moving the second track means comprises common driving means for moving the carriage along the second track means and for moving the second track means along the first track means.

6. A stairlift according to claim 5, wherein the driving means includes means whereby the second track means is moved to the end of the flight of stairs before the carriage is moved.

7. A stairlift according to claim 5, wherein the stairlift further comprises a control unit means for operating the means for controllably moving the carriage and the second track means located at each of the top of the flight of stairs, the bottom of the flight of stairs and the carriage.

8. A stairlift according to claim 2, wherein the moving means include means whereby the second track means is moved to its end position before the carriage is moved.

9. A stairlift according to claim 1, further comprising safety edges located on said second track means, such that said safety edges prevent movement of the second track means, if the second track means meets an obstruction in its path, towards that obstruction, said safety edges only permitting movement of said second track means away from said obstruction.

10. A stairlift according to claim 1, wherein the length of the second track means is less than the length of the flight of stairs.

* * * * *